US006558155B2

(12) United States Patent
Coudamy

(10) Patent No.: US 6,558,155 B2
(45) Date of Patent: May 6, 2003

(54) PROCESS FOR ADJUSTING THE WATER VAPOR CONTENT IN A VERY HIGH TEMPERATURE FURNACE

(75) Inventor: Gérard Coudamy, Limoges (FR)

(73) Assignee: Ceric, Paris (FR)

( * ) Notice: Subject to any disclaimer, the term of this patent is extended or adjusted under 35 U.S.C. 154(b) by 123 days.

(21) Appl. No.: 09/791,780

(22) Filed: Feb. 26, 2001

(65) Prior Publication Data

US 2001/0024775 A1 Sep. 27, 2001

(30) Foreign Application Priority Data

Feb. 25, 2000 (FR) ..... 00 02371

(51) Int. Cl.[7] ..... F27B 3/20
(52) U.S. Cl. ..... 431/12; 431/89; 432/19
(58) Field of Search ..... 431/3, 4, 12, 89; 432/19, 159; 65/157; 422/182; 110/205, 214

(56) References Cited

U.S. PATENT DOCUMENTS

| | | | | | |
|---|---|---|---|---|---|
| 3,363,993 | A | * | 1/1968 | Campbell | 422/182 |
| 4,050,877 | A | * | 9/1977 | Craig et al. | 431/12 |
| 4,309,168 | A | * | 1/1982 | Prill et al. | 431/12 |
| 4,462,792 | A | | 7/1984 | Roth et al. | |
| 4,927,348 | A | * | 5/1990 | Avidan | 110/345 |
| 5,569,312 | A | * | 10/1996 | Quirk et al. | 110/214 |
| 6,289,694 | B1 | * | 9/2001 | Pieper | 65/134.6 |

FOREIGN PATENT DOCUMENTS

| | | |
|---|---|---|
| FR | 2179532 | 11/1973 |

* cited by examiner

*Primary Examiner*—Sara Clarke
(74) *Attorney, Agent, or Firm*—Young & Thompson

(57) ABSTRACT

Process for regulating the water vapor content in a furnace operating at very high temperature between 1300 and 1800° C. and heated by combustion burners, in which there used as combustible carbon monoxide and as combustion supporter oxygen or air if desired dried and/or enriched in oxygen.

4 Claims, 1 Drawing Sheet

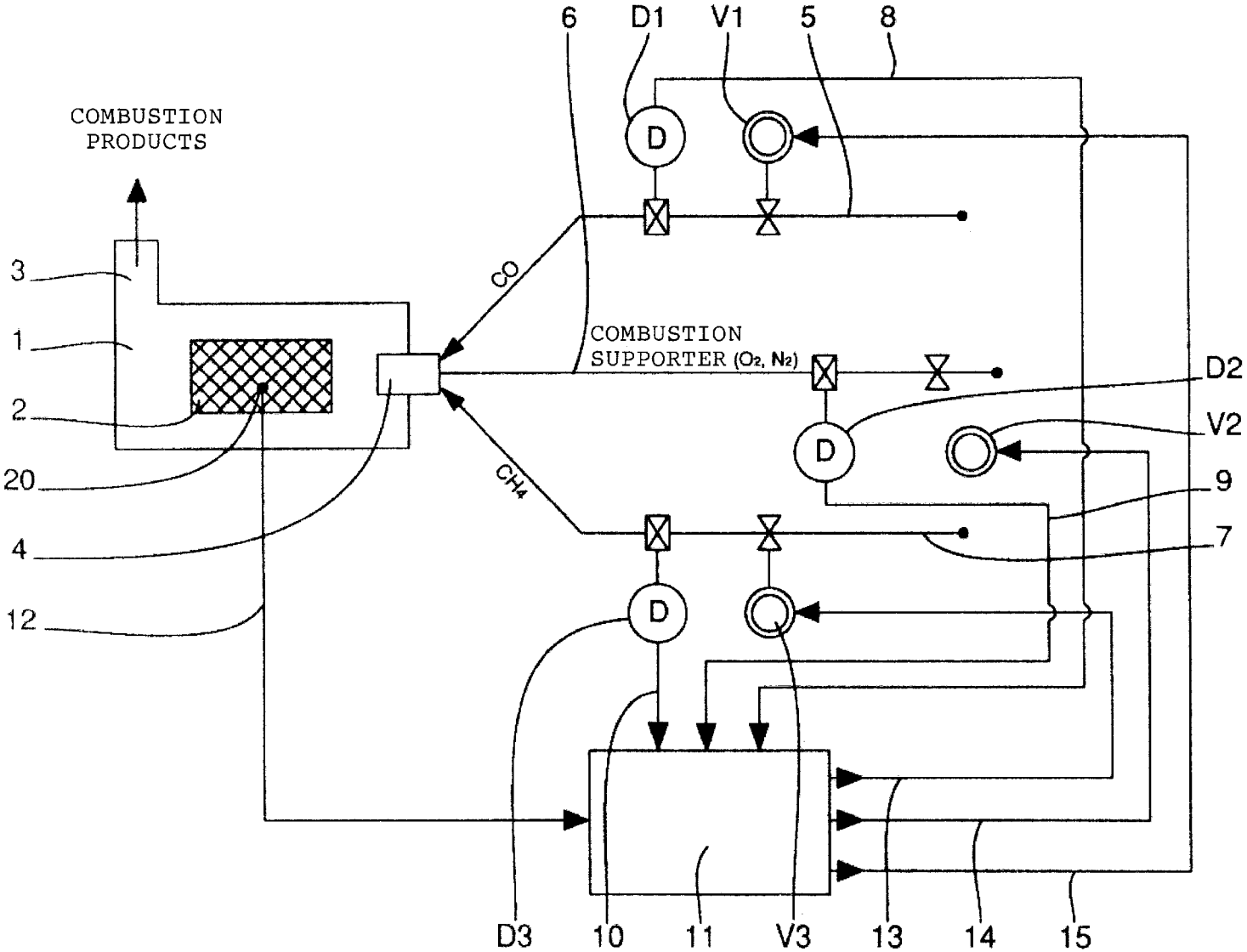
D2
V2
9
7
15
14
13
8
5
V1
D1
6
D
D
D
D
V3
11
10
D3
COMBUSTION SUPPORTER ($O_2$, $N_2$)
CO
$CH_4$
COMBUSTION PRODUCTS
3
1
2
20
4
12

PROCESS FOR ADJUSTING THE WATER VAPOR CONTENT IN A VERY HIGH TEMPERATURE FURNACE

The invention relates to a process for regulating the water vapor content in a very high temperature furnace, and particularly in a furnace for baking ceramics and carbonaceous products.

It is known that in the production of technical ceramics and carbonaceous products at temperatures of 1300 to 1800° C. in furnaces with burners, that the presence of water vapor resulting from the combustion of the hydrocarbon combustibles from the burners has undesirable consequences as to the quality of the ceramics and the carbonaceous products obtained.

At lower temperatures, this drawback is overcome by using electric furnaces or furnaces with radiant burners, in which furnaces no water vapor is produced. But it is technically and economically difficult to achieve temperatures of 1300 to 1800° C. with such furnaces and the furnaces burning combustibles are required.

As the invention thus provides a process for adjusting the water vapor content in a very high temperature furnace, which consists in using as the essential combustible, carbon monoxide and as the combustion supporter, oxygen or air enriched in oxygen.

Carbon monoxide can be used alone or combined with a small quantity of hydrocarbon combustible (natural gas for example), small quantity being calculated to give a predetermined quantity of water vapor in the furnace.

The equations prevailing in the combustion are as follows:

$$2CO+O_2+(xN_2)\rightarrow 2CO_2+(xN_2) \quad 1)$$

$$CH_4+2O_2+(yN_2)\rightarrow CO_2+2H_2O+(yN_2) \quad 2)$$

(equations similar to 2) are written for diverse hydrocarbons $C_nH_{2n-2}$ other than methane).

In the case of equation 1), there is no production of water; whilst in equation 2), corresponding schematically to the use of natural gas as combustible, the formation of a large quantity of water is shown.

On the contrary, if there is introduced a small flow rate of natural gas into the burner, the quantity of water present in the furnace can be predetermined and adjusted.

Moreover, the use of CO has other advantages relative to the use of natural gas and permits limiting the volume of the fumes and also improving the thermal output.

It is seen that according to equations 1 and 2, with stoichiometric combustion, the volume ratio of the combustion supporter to the combustible favors carbon monoxide relative to methane (natural gas) when using pure oxygen or air as the combustion supporter.

$$\frac{\text{volume } O_2}{\text{volume CO}} = 0.5 \quad \frac{\text{volume air}}{\text{volume } CH_4} = 2.38$$

whilst $$\frac{\text{volume } O_2}{\text{volume } CH_4} = 2 \quad \frac{\text{volume air}}{\text{volume } CH_4} = 9.53$$

The same advantageous ratio obtains for the production of fumes:

$$\frac{\text{volume of fumes (air)}}{\text{volume CO}} = 2.89 \quad \frac{\text{volume of fumes (air)}}{\text{volume } CH_4} = 10.56$$

Moreover, the energy released by the combustion of a cubic meter of CO (with air at 20° C.) is 12 MJ/m$^3$ and gives a theoretical adiabatic temperature of 2468° C. (apart from the energy of dissociation) or 1958° C. (with the energy of dissociation).

This temperature is thus sufficient for the furnace and the product to be heated to reach a temperature of 1800° C.

The energy released by the combustion of a cubic meter of $CH_4$ under the same conditions being 33.9 MJ/m$^3$ "net heating value", the quantity of fumes released by MJ is also favorable for the combustion of CO $$\frac{\text{volume of fumes (air)}}{\text{MJ CO}} = 0.24 \quad \frac{\text{volume of fumes (air)}}{\text{MJ } CO_4} = 0.31$$

It will be noted that the thermal output for the combustion of pure CO is further improved by the absence of the formation of water, because the energy of vaporizing this water is saved.

Carbon monoxide is more expensive combustible than natural gas or the other conventional combustibles, but the advantages that it gives and the very great technical difficulty to obtain temperatures of 1800° C. with electric furnaces or radiant burners on an industrial scale, compensate this drawback.

The combustion supporters constituted by air which can be dried if it is desired to obtain an atmosphere free from water or by air enriched in oxygen up to the point of being pure oxygen.

There will now be described an example of embodiment of an installation for the practice of the process, with reference to the single FIGURE, which is a schematic illustration of a device for practicing the present invention.

A baking furnace 1 contains the product 2 to be heated and is provided with a chimney 3 for evacuating combustion products and a burner 4.

The burner 4 is supplied with carbon monoxide by a conduit 5 on which are mounted a detector $D_1$ for measuring flow rate of CO and a regulating valve $V_1$ for the flow rate of CO. The combustion supporter ($O_2$ or air) is supplied to the burner by a conduit 6 provided with a detector $D_2$ for measuring the flow rate of the combustion supporter and an adjustment valve $V_2$ for this flow rate. A third conduit 7, also provided with a flow rate detector $D_3$ and a regulating valve $V_3$ for the flow rate, permits supplying the burner 4 with hydrocarbonaceous combustibles symbolized in the drawing by $CH_4$ but which can comprise higher hydrocarbons $C_nH_{2n+2}$.

In transfer lines 8, 9, 10 flows information supplied by the detectors D1, D2 and D3 respectively to a computer 11 which receives via the transfer line 12 an indication of the temperature in the furnace with the help of a detector 20. Knowledge of the temperature in the furnace is useful for conducting the heating process but does not take part in the adjustment of the water content.

The computer 11 computes the different parameters and as a function of the desired water content, adjusts the flow rate $CH_4$ by means of the adjustment valve $V_3$ via the connection 13.

Connections 14 and 15 also permit adjusting the flow rates of the combustion supporter and of the combustible, respectively, via the valves V2 and V1.

By way of example, there will be seen below equations for the combustion of a mixture of CO and $CH_4$ which supply the basis for the algorithm used by the computer $$\frac{\text{Volume of the products of combustion}}{\text{Volume of } CO + CH_4} = \%\ CO \times 0.0289 + \%\ CH_4 \times 0.1056 + (\%EAIR* / 100) \times 0.0239 \times [\%\ CO + 4\%\ CH_4]$$

$$\frac{\text{Volume of } H_2O}{\text{Volume of } CO + CH_4} = \%\ CH_4 \times 0.02$$

$$\frac{\text{Volume of } H_2O}{\text{Volume of } CO + CH_4} = \frac{\%\ CH_4 \times 0.02}{\%\ CO \times 0.0289 + \%\ CH_4 \times 0.1056 + (\%\ EAIR* / 100) \times 0.0239 \times [\%\ CO + 4\%\ CH_4]}$$

in which FAIR: excess of air is the quantity of dry air supplied in excess of the quantity necessary for stoichiometric combustion. EAIR=0 for stoichiometric combustion.

The adjustment of the excess air, hence of the oxygen content, can be carried out by this algorithm which also shows that by measuring the flow rate of CO, the flow rate of $CH_4$ and the flow rate of the composition of the combustion supporter, it is possible to know and hence to regulate the volume of water relative to the volume of the combustion products and thereby to improve the water concentration.

This algorithm is given for an equilibrium reaction and can be refined to take account of equilibrium values. Similar algorithms can be computed for other hydrocarbons present in the hydrocarbon combustible.

What is claimed is:

1. A process for regulating the water vapor content in a furnace functioning at very high temperature between 1300 and 1800° C. and heated by combustions burners, comprising using carbon monoxide as a combustible, and using as a combustion supporter at least one member of the class consisting of oxygen, air, dried air, and air enriched in oxygen.

2. A process according to claim 1, wherein there is also used as a combustible a proportion of hydrocarbon computed to obtain a predetermined content of water vapor in the combustion product.

3. A furnace for heating a product, a burner for heating the furnace, means to supply carbon monoxide to the furnace, a first flow rate detector for detecting the flow rate of carbon monoxide, a first valve for adjusting the flow rate of carbon monoxide, means to provide a combustion supporter to rho furnace, a second flow rate detector for detecting the flow race of the combustion supporter, a second valve for regulating the flow rate of the combustion supporter, and a computer functionally connected to both said flow rate detectors and to both said valves to regulate the flow rates of at least one of the combustible and the combustion supporter according to the water vapor content desired in the furnace.

4. A furnace according to claim 3, further comprising means to supply a hydrocarbon combustible to the furnace in an amount to obtain a predetermined content of water vapor in the combustion product.

* * * * *